United States Patent [19]

Mortensen

[11] 4,208,922

[45] Jun. 24, 1980

[54] ENGINE STARTER DRIVE ASSEMBLY WITH SHIELDING MEANS

[75] Inventor: Harold R. Mortensen, Horseheads, N.Y.

[73] Assignee: Facet Enterprises, Inc., Tulsa, Okla.

[21] Appl. No.: 932,965

[22] Filed: Aug. 11, 1978

Related U.S. Application Data

[63] Continuation of Ser. No. 741,812, Nov. 15, 1976, abandoned.

[51] Int. Cl.[2] ..... F02N 11/00

[52] U.S. Cl. ..... 74/7 R

[58] Field of Search ..... 74/6, 7 R, 7 A, 7 D; 290/38 B, 38 A, 38 R, DIG. 1

[56] References Cited

U.S. PATENT DOCUMENTS

| | | | |
|---|---|---|---|
| 1,591,832 | 7/1926 | Jackson | 74/7 |
| 2,845,801 | 8/1958 | Bridges | 74/6 |
| 2,907,216 | 10/1959 | Smith | 74/7 |
| 2,987,059 | 6/1961 | Mendenhall et al. | 74/7 R |
| 3,124,694 | 3/1964 | Seilly | 74/7 X |
| 3,630,092 | 12/1971 | Matsumoto et al. | 74/7 R |
| 3,656,355 | 4/1972 | Matsumoto | 74/7 B |
| 3,690,188 | 9/1972 | McMillen | 74/7 R |

FOREIGN PATENT DOCUMENTS 804626 11/1956 United Kingdom .

*Primary Examiner*—Irwin C. Cohen
*Attorney, Agent, or Firm*—Remy J. VanOphem

[57] ABSTRACT

An engine starter drive assembly is disclosed of the type including a pinion gear moveable from a rest position to a driving position in engagement with gear teeth formed on an engine flywheel, the pinion adapted to be rotated by the starter motor in order to start the engine after engaging the flywheel teeth. In order to be properly located with respect to the flywheel gear teeth, the pinion gear moves axially into engagement with a fixed stop located at a predetermined position to produce proper engagementof the pinion with the flywheel teeth. The starter also includes an antidrift compression spring and washer assembly biasing the pinion gear against axial movement out of the retracted position. The disclosed starter assembly features a shielding cup supported on the fixed stop and extending towards the pinion gear hub extension to enclose the space therebetween, preventing the build-up of foreign matter tending to interfere with the axial movement of the pinion gear. In one embodiment, the cup is axially fixed to the fixed stop and a hub extension of the pinion gear slides into the cup during axial movement of the pinion gear, while in a second embodiment the cup is slidably supported on the fixed stop and formed integral with the antidrift thrust washer engaged with the pinion gear hub extension so as to move axially therewith during initiation of a starting cycle.

1 Claim, 2 Drawing Figures

ENGINE STARTER DRIVE ASSEMBLY WITH SHIELDING MEANS

This is a continuation of application Ser. No. 741,812, filed Nov. 15, 1976, and now abandoned.

BACKGROUND OF THE INVENTION

1. Field of the Invention

This invention concerns starter drives and more specifically starter drives of the types used in cranking small internal combustion engines.

2. Description of the Prior Art

In providing an electric start capability for small internal combustion engines such as are used in powering garden tractors, etc., the starter pinion gear used to rotate the engine flywheel is often unenclosed by the flywheel housing, contrary to designs for car and truck starters. Also, the environment in which such equipment is operated is typically one in which foreign matter could become lodged in the various exposed components thereof such as the starter assembly. Such starters commonly utilize a design wherein a pinion gear is moved axially into engagement with the flywheel gear teeth by an inertia drive arrangement including a threaded engagement between a screw thread by the starter shaft and the pinion gear tending to cause axial movement of the pinion gear upon rotation of the starter shaft due to inertia of the pinion gear. The pinion gear moves axially against a fixed stop which locates the pinion gear axially so as to properly engage the flywheel gear teeth.

These designs thus can become wholly or partially inoperative if dirt or other foreign matter becomes lodged in the space between the pinion gear and the fixed stop, since the axial movement of the pinion gear would thereby be interfered with.

This problem has heretofore been recognized and attempts to solve this problem have included shielding means adapted to enclose this space to prevent the entrance of dirt, grime or other such contaminants.

Examples of these arrangements are found in U.S. Pat. Nos. 3,690,188; 3,124,694; and 2,987,059. A related arrangement is also shown in U.K. Pat. No. 804,626, published Nov. 19, 1958. However, all of these patents have the common feature that they are supported either partially or wholly on the pinion gear so as to tend to be rotated therewith during the axial movement described, and as such tend to be loosened by the sudden stopping and starting of rotation and axial movement of the pinion gear. This factor is aggravated by the constraints the mounting on the pinion gear (or an extension thereof) imposes, i.e., the shield is either simply overhung unsupported at its free end or slidably mounted on the fixed stop, such that it is not positively retained.

It is accordingly an object of the present invention to provide a shield arrangement for starter motors of the type described in which a positive retention of the shield is provided, and which the loosening effects of movement of the pinion gear during starting cycles is avoided.

SUMMARY OF THE INVENTION

This and other objects which will become apparent upon a reading of the following specification and claims is accomplished by an arrangement for mounting a shielding cup on the fixed stop either alone or on the fixed stop and the starter shaft structure rather than to the pinion gear. In a first embodiment, the shielding cup is fixed to the starter shaft end, and radially located at one end on the fixed stop and at the other end on the antidrift washer, which is mounted to be slidable within the shielding cup, so that a pinion gear hub extension in engagement with the antidrift washer moves axially into the cup during the axial movement of the pinion gear. In a second embodiment, the shielding cup is formed integrally with the antidrift washer and slidably mounted on the outside diameter of the fixed stop so as to move axially with the pinion gear hub extension during initiation of a starting cycle.

DETAILED DESCRIPTION

In the following specification and claims particular embodiments will be described in accordance with 35 U.S.C 112 and specific terminology employed for the sake of clarity, but it is to be understood that these are not intended to be limiting and it is to be understood that the invention is not so limited and may take many forms within the scope of the appended claims.

Figure 1:
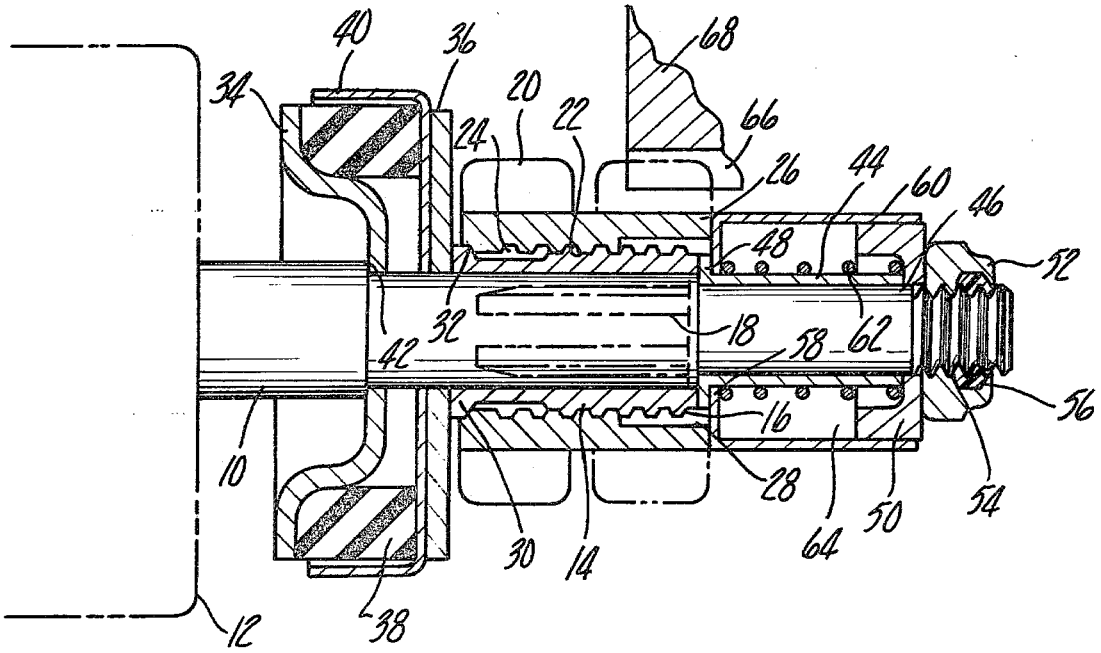
FIG. 1 is a fragmentary view in partial section of a starter motor assembly according to the present invention.

Referring to the drawing, and paricularly FIG. 1, a portion of a starter drive shaft 10 extending from the starter motor 12 is shown which is adapted to be rotated by the starter motor 12 upon activation by a suitable starting circuit typically including a relay and solenoid (not shown) of conventional design. Since such starter motors and associated circuitry is very well known to those skilled in the art and do not in them selves form a part of the present invention, the details of these will not be herein described.

The drive shaft 10 carries a screw shaft 14 having an external helical thread form 16 formed thereon and a splined connection therebetween at 18 so as to rotate with the drive shaft 10. A driving member comprised of a pinion gear 20 is mounted on the screw shaft 14 and has formed a mating internal thread 22 formed on an internal bore engaging the external threads 16 of the screw shaft 14.

To reduce the frictional resistance created by the screw thread engagement during initial axial movement of the pinion gear 20 from the position shown in FIG. 1, the thread form 16 on the screw shaft 14 is relieved at 24 and the pinion gear 20 is formed with an extension hub 26 having an internal relief at 28. Thus, in the retracted position shown, only a portion of the respective threads are engaged.

A shoulder 30 is also formed on the screw shaft 14 engaging a similar stop 32 formed on the internal bore of the pinion gear 20 to arrest further retracting rotation of the pinion gear 20 and thus provide an axial stop means during retracting movement of the pinion gear 20 to the left as viewed in FIG. 1.

A cushioning arrangement is included to absorb the high peak loads that are encountered during initial engagement of the pinion gear 20 with gear teeth 66. This arrangement includes a pair of cushioning washers 34 and 36, metallic cup 40, and annular rubber cushion 38. Cushioning washer 34 is abutted on a shoulder 42 formed on the drive shaft 10 so that the rubber cushion 38 will be compressed by the cushion washer 36 when forced to the left by the screw shaft 14 due to the reactionary thrust load created between the pinion gear 20 and screw shaft 14 by thread 22 when the pinion gear 20 is in engagement with stop 50. Thus, minimizing the shock load that could be transmitted into the starter drive shaft 10. The splined connection between the screw shaft 14 and the drive shaft 10 accommodates the resulting slight axial movement of the screw shaft 14 to accomplish this end.

The screw shaft 14 is axially located on the drive shaft 10 by a bearing sleeve 44 slidably disposed on a reduced outside diameter end portion 46 of the drive shaft 10, with a radial lip 48 integral with the bearing sleeve 44 abutting the (outer) end of the screw shaft 14.

Bearing sleeve 44 also serves to locate an axial stop 50 which is retained between the bearing sleeve 44 and a nut 52 threaded on the end 54 of the drive shaft 10 and torqued into firm engagement therewith to axially position the respective elements and properly preload the rubber cushion 38. A locking insert 56 is also included to insure that the nut 52 will not loosen during normal operation.

The pinion gear 20 is biased to the left or retracted position shown in FIG. 1 by virtue of engagement with a radially inwardly directed lip 58 formed on a shielding cup 60, and a compression spring 62 encircling the drive shaft reduced outside diameter end portion 46 and engaging the axial stop 50 at one end and the lip 58 at its other end.

The lip 58 thus functions as an antidrift thrust washer which prevents the pinion gear 20 from advancing on the screw shaft 14 in the absence of rotation of the drive shaft 10 as a result of vibrations, etc.

The shielding cup 60 is radially located at its other end from lip 58 by virtue of a sliding fit over the axial stop 50 so that the space 64 is entirely enclosed at all times. It can be seen that the shielding cup 60 is very securely retained in the assembly and is not mounted on the pinion gear 20 so as to be loosened by its movement, i.e., is mounted by means independently of the pinion gear 20.

The shielding cup 60 may be constructed of metal, plastic, or hard rubber having suitable strength characteristics.

In operation, assuming the pinion gear 20 is in its rest position as shown in FIG. 1, upon activation of the starter motor, the drive shaft 10 is rotated, in turn causing the screw shaft 14 to be rotated by virtue of the splined connection 18. The inertia of the pinion gear 20 creates a tendency for relative rotation between it and the screw shaft 14, with the threaded connection being in the direction such as to cause advancing movement of the pinion into engagement with gear teeth 66 formed on the flywheel 68. Upon axial advance of the pinion gear 20, the pinion gear extension hub 26 axially advances the shielding cup 60 until the lip 58 moves into abutting relationship with the fixed stop 50, which arrests further relative rotation between the pinion gear 20 and the screw shaft 14 causing the pinion gear 20 to be rotated with the drive shaft 10. The fixed stop 50 is located so that proper mesh between the pinion gear 20 and the gear teeth 66 has been achieved such that the engine is thereby cranked.

Upon firing of the engine, the pinion gear 20 is caused to be rapidly accelerated so as to be rotated much faster than rotation of the drive shaft 10, the threaded connection with the screw shaft 14 causes the pinion gear to be retracted out of engagement with the flywheel gear teeth 66, and into engagement with the shoulder 30 which acts to arrest rotation of the pinion gear.

Figure 2:
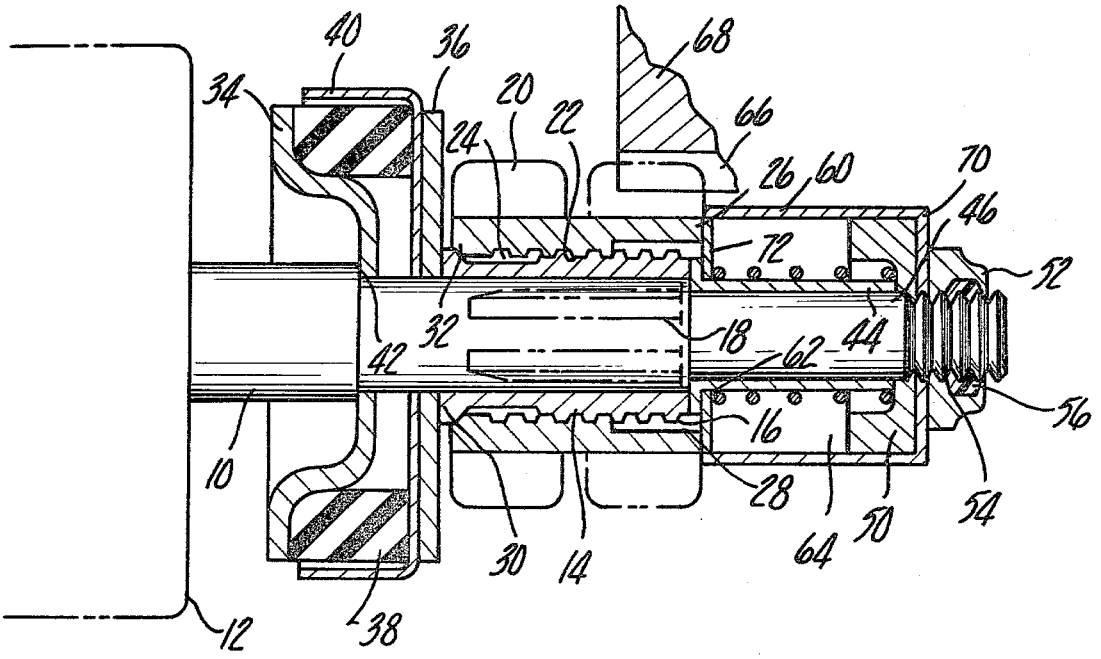
FIG. 2 is a fragmentary view of a starter motor in partial section of a second embodiment of a starter motor according to the present invention.

A second embodiment is shown in FIG. 2, and includes the same basic arrangement of elements as the embodiment depicted in FIG. 1. However, in this embodiment, the shielding cup 60 is fixed with respect to the driving shaft 10 by virtue of having a radial inwardly extending lip 70 secured between the fixed stop 50 and the retainer nut 52. In this embodiment, a separate antidrift thrust washer 72 is provided which locates and supports the free end of the shielding cup 60 when the pinion gear 20 is in the retracted position. Upon axial advance of the pinion gear 20, the extension hub 26 moves into the shielding cup 60 until the antidrift thrust washer 72 abuts the fixed stop 50.

It can thus be seen that the object of the present invention has been achieved by this arrangement since the shielding cup is mounted in such a way that it is not subjected to loosening by virtue of being connected to or supported on the pinion gear. It can be further appreciated that this object has been achieved by a relatively simple, inexpensive arrangement which ensures complete enclosure of the normally exposed space between the pinion gear and the fixed stop.

What is claimed is:

1. An improved engine starter assembly comprising:

a driving shaft having an end and an opposite section disposed away from said end;

a pinion gear mounted on said opposite section for relative axial and rotatable movement with respect thereto, said pinion gear having a flange disposed radially from said shaft and extending along said opposite section of said shaft toward said end;

means moving said pinion gear to and from a retracted position opposite said end, into and out of driving engagement with an engine flywheel;

a stop axially fixed on said shaft toward said end in a position spaced away from said opposite section and said pinion gear when said pinion gear is in the retracted position, said stop locating said pinion gear when said pinion gear is in engagement with said engine to be started;

a bearing sleeve mounted about said shaft between said stop and said opposite section, said bearing sleeve having a radially extending shoulder opposite said axial stop, adjacent said opposite section, and touching said end of the driving shaft;

resilient means disposed about said shaft between said stop and said shoulder;

a shielding cup radially disposed about said shaft toward said end in a position spaced away from said opposite section, said shielding cup includes a radially inwardly extending lip slidably mounted on said bearing sleeve and biased by said resilient means into abutting engagement with said pinion gear flange and said bearing sleeve shoulder, and said shielding cup being slidably supported on said fixed axial stop;

whereby said flange of said pinion gear and said cup cooperate to prevent foreign matter from entering both between said flange and said shaft, and between said cup and said shaft.

* * * * *